United States Patent [19]

Muus

[11] Patent Number: 5,025,647

[45] Date of Patent: Jun. 25, 1991

[54] LOCK ARRANGEMENT

[75] Inventor: Frank Muus, Moss, Norway

[73] Assignee: TrioVing a.s., Norway

[21] Appl. No.: 435,417

[22] PCT Filed: Mar. 31, 1989

[86] PCT No.: PCT/NO89/00026

§ 371 Date: Nov. 3, 1989

§ 102(e) Date: Nov. 3, 1989

[87] PCT Pub. No.: WO89/11576

PCT Pub. Date: Nov. 30, 1989

[51] Int. Cl.[5] ..... E05B 21/00

[52] U.S. Cl. ..... 70/352; 70/385; 70/387

[58] Field of Search ..... 70/352, 338, 382–384, 70/385–387

[56] References Cited

U.S. PATENT DOCUMENTS

| | | | |
|---|---|---|---|
| 967,066 | 8/1910 | Schwob | 70/352 X |
| 2,427,837 | 9/1947 | Connell | 70/385 |
| 2,818,723 | 1/1958 | Levin | 70/338 |
| 3,505,841 | 4/1970 | Sinclair | 70/385 X |
| 3,588,397 | 6/1971 | Ellefson | 70/387 X |
| 3,595,042 | 7/1971 | Sedley | 70/352 X |
| 3,995,460 | 12/1976 | Sedley | 70/387 X |
| 4,149,394 | 4/1979 | Sornes | 70/352 |
| 4,287,737 | 9/1981 | Ahn | 70/352 X |
| 4,452,059 | 6/1984 | Sornes | 70/352 X |
| 4,531,389 | 7/1985 | Foshee | 70/385 X |

FOREIGN PATENT DOCUMENTS

| | | | |
|---|---|---|---|
| 254680 | 3/1964 | Netherlands | 70/385 |

*Primary Examiner*—Robert L. Wolfe
*Assistant Examiner*—Suzanne L. Dino
*Attorney, Agent, or Firm*—Lucas & Just

[57] ABSTRACT

A mechanical card-serviced lock comprises a housing (1), a locking member (2) which is displaceably arranged in the housing, blocking pins (12, 13) which by means of a key card (4) are mechanically movable between positions where they prevent and permit, respectively, relative movement between the locking member and the housing, and means (3, 18) for selectably changing the total length of the blocking pins in order to set the combination of the lock in correspondance with a key card (4) introduced in the lock.

7 Claims, 4 Drawing Sheets

LOCK ARRANGEMENT

The present invention relates to a lock comprising a housing, a locking member which is movably arranged in the housing, a slot for receiving a plate-like key member, blocking pins, each consisting of several parts and which by means of the plate-like key member are mechanically displaceable in cylindrical chambers between positions wherein they prevent and permit, respectively, relative movement between the locking member and the housing.

Such a lock is known from the applicant's prior US-PS No. 4 149 394, which hereby is included as reference. In this prior art lock the combination of the lock is formed by a code card which is inserted from the rear side of the lock housing. The code card has a hole combination which is the opposite of the hole combination of the key card able to open the lock.

Even though this prior art lock has proven itself very advantageous in use in hotels and the like due to its simple and inexpensive recodability, it nevertheless has the disadvantage that the lock must be approached in order for it to be coded by means of a new code card before a new user can use the lock by means of his key card. This can be cumbersome when one wishes to change the combination often in several locks, as is the case in a hotel.

The object of the invention is therefore to provide a lock which may be coded without the necessity for the hotel staff to follow the guest to the room to perform the recoding.

This is obtained according to the invention in a lock of the type mentioned above, which is characterized in that the lock comprises means for changing the total length of the various locking pins, thereby changing the combination of the lock.

By means of the invention it will be possible to perform the recoding by means of the key itself. The user, e.g. the hotel guest, may thereby himself perform the coding when he uses the key in the lock for the first time.

According to an advantageous embodiment of the invention, said means comprises code chambers in the locking member, having springs and coding disks, said coding chambers being arranged in a pattern corresponding to that of the chambers of the blocking pins but displaced with respect to these, and a recoding slide which is slidably arranged in the housing and is provided with chambers in a pattern corresponding to the chambers of the blocking pins, said slide being arranged adjacent to the locking member and being displaceable with respect to same between a first and a second position, the chambers of the slide coinciding with the coding chambers of the coding disks in the first position and with the chambers of the blocking pins in the second position.

By means of such an embodiment one may recode the lock quite simply by displacing the recoding slide from its first to its second position after having first brought the key member in place in its slot.

According to the invention it is also suggested to arrange the slot for the key member in the recoding slide. Thus, the key may be used to displace the recoding slide during the recoding.

In order for the key member to be entered into and removed from the lock without unnecessary friction and wear, according to the invention, the part of the blocking pins situated closest to the key slot has been given the form of a sphere. In order to use throughgoing holes in the key member for forming its code, it may be advantageous to let the coding disks have the same thickness as the key member.

According to a further development of the invention, at least one further chamber for a control pin is present, the control pin preferably being somewhat longer than the blocking pins, said further chamber not having a corresponding coding chamber. By means of this control pin it is possible e.g. to prevent that the code of the lock is inadvertently erased.

Furthermore, the invention comprises a card-like key member, having a combination in the form of holes, for use in a lock provided with a control pin as described above, the key member being characterized in that it has a hole in the position for the control pin.

Finally, the invention relates to a device for erasing a combination set by means of the above noted key member, said device being characterized in that it is formed generally as the key member and has the same hole combination, except that it does not have a hole in the position for the control pin.

Further details and advantageous features of the invention will be apparent from the following description of the exemplifying embodiment of the invention shown schematically in the appended drawings.

Figure 2:
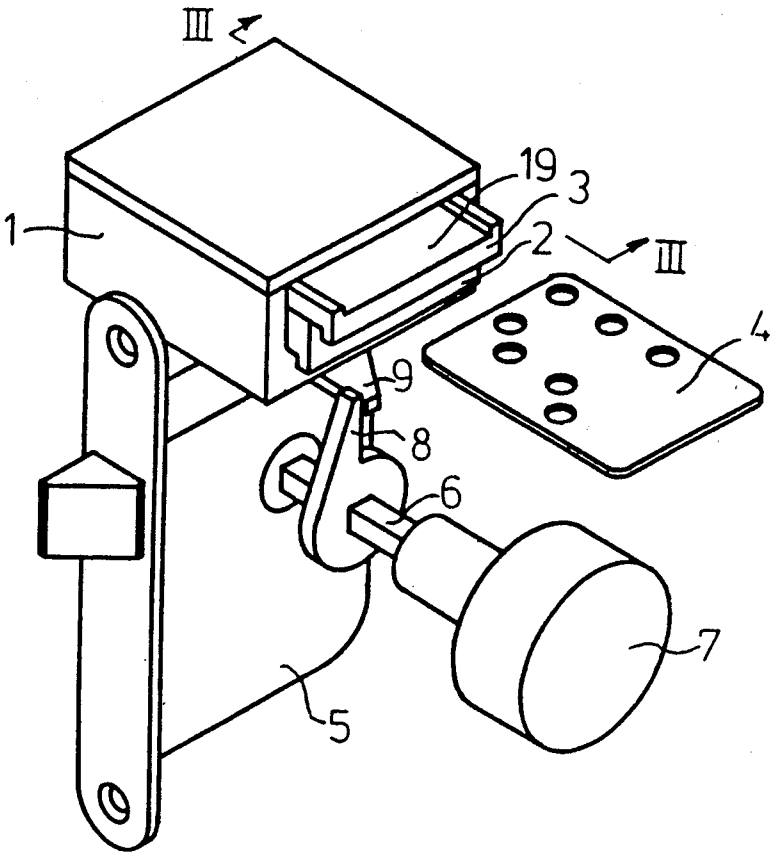
FIG. 2 shows the lock in FIG. 1, with the door and some other parts removed for the sake of clarity.
Figure 1:
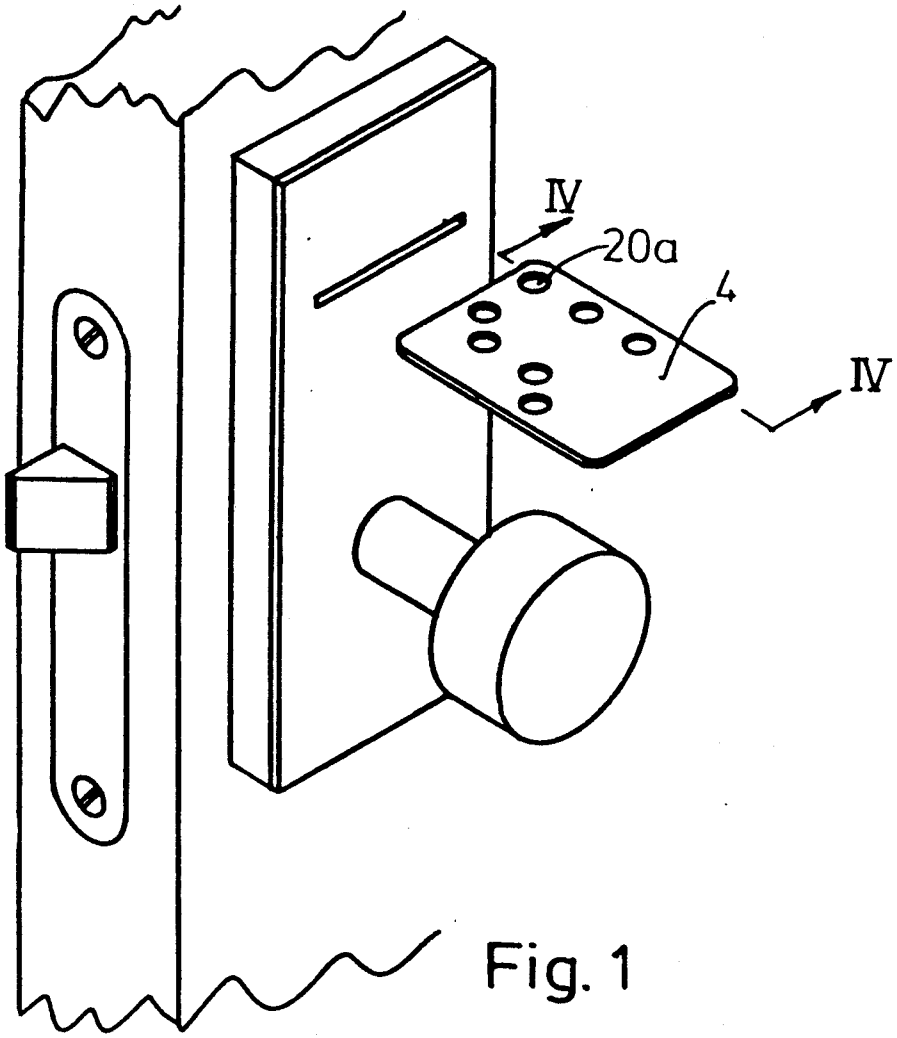
FIG. 1 shows in perspective view a portion of a door where a lock according to the invention is installed.

The lock arrangement shown in FIG. 2 comprises a housing 1, a locking member 2 which is displaceably arranged in the housing, and a recoding slide 3, which also is displaceably arranged in the housing 1. In FIGS. 1 and 2 it is also shown a punched key card 4 for use with the lock.

In FIG. 2 it is also shown a common door lock 5, having a square bolt 6 to be served by a door handle 7. On the square bolt 6 a disk having a protruding nose 8 is fixed against rotation. The nose rests against a blocking projection 9, which is connected to the locking member 2 of the lock (on the side of the lock not being visible), so that when the locking member is displaced in the lock housing 1, the blocking projection 9 is pulled in the direction towards the housing, thus permitting the disk with the nose 8, and thus the square bolt 6, to be rotated clockwise.

Figure 3:
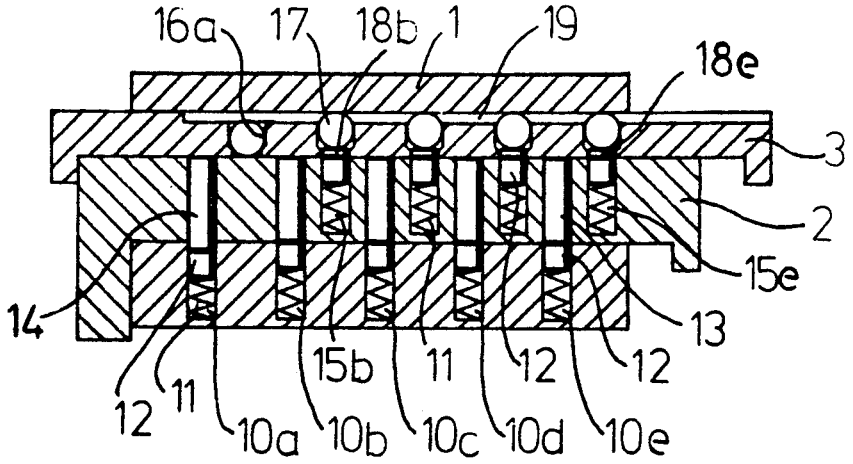
FIG. 3 is a vertical section along the line III—III in FIG. 2.
Figure 15:
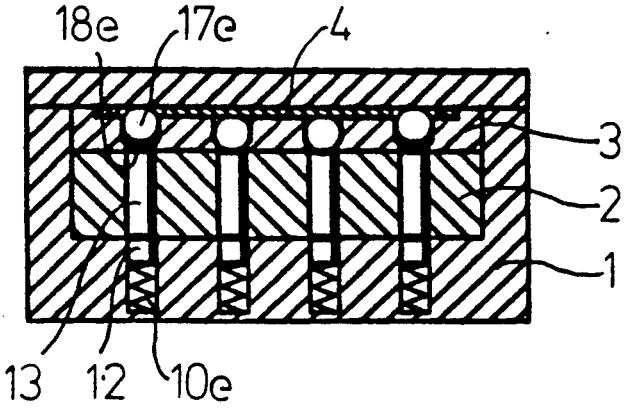
FIG. 15 shows a section along the line XV—XV in FIG. 11.

Next, it is referred to FIG. 3, wherefrom it is apparent that the housing 1 and the locking member 2 are provided with chambers 10*a*–10*e* for blocking pins. It will be understood that in front of the drawing plane, there will be further rows of such chambers, e.g. as suggested in FIG. 15, these chambers forming a predetermined pattern.

In the chambers 10*a*–10*e* springs 11 and so-called casing or bottom pins 12 are located. The chambers 10*b*–10*e* also have main pins 13, while the chamber 10*a* has a somewhat longer pin 14, a so-called control pin.

In the locking member 2 coding chambers 15*b*–15*e* are also present, said chambers, like the chambers of the blocking pins, being provided with springs 11 and casing pins 12. The coding chambers 15*b*–15*e* are arranged in the same pattern as the chambers 10*b*–10*e* of the blocking pins but are displaced a predetermined distance with respect to these, as will be explained more closely below.

The recoding slide 3 is provided with a number of chambers 16*a*–16*e*, which are arranged in the same pattern as the chambers 10*a*–10*e* of the blocking pins. The chambers of the recoding slide contain spheres 17, and all except the chamber 16*a* contain coding disks 18*b*–18*e*.

It will be seen that in the relative position between the locking member 2 and the recoding slide 3 shown in FIG. 3, the chambers 16*b*–16*e* of the recoding slide 3 form extensions of the coding chambers 15*b*–15*e* of the locking member 2.

The lock has a slot 19 for the key card 20, said slot being formed as a recess in the top side of the recoding slide 3. This recess may also be seen in FIG. 2.

Figure 4:
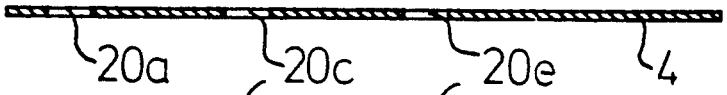
FIG. 4 is a section through a key member according to the invention along the line IV—IV in FIG. 1.
Figure 5:
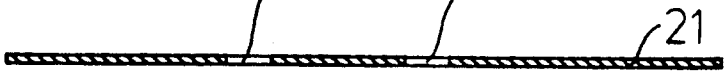
FIG. 5 is a section similar to FIG. 4 through a combination erasing device according to the invention.

FIG. 4 shows a section through a key card 4. It will be seen that the key card has holes 20*a*, 20*c* and 20*e*, while it is solid in positions b and d. FIG. 5 shows a so-called erasing card 21, which is used to erase a previously set combination in the lock, as will be described more closely below. The erasing card 21 is identical to the key card 4, except that the erasing card does not have a hole in position a.

The function of the lock will be explained more closely in the following.

Figure 6:
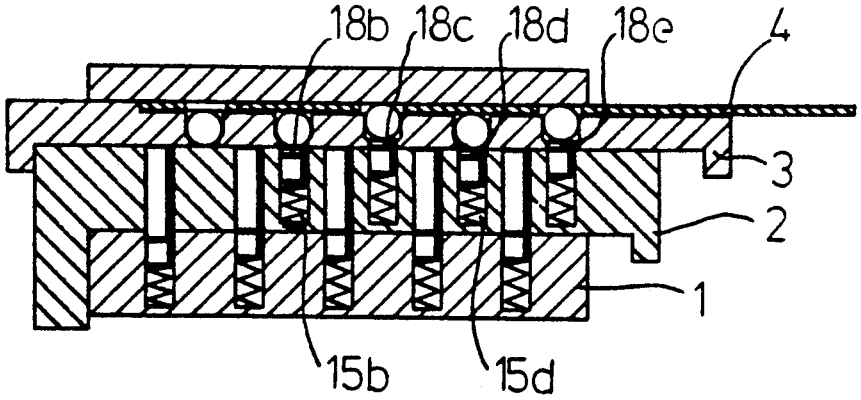
FIGS. 6–13 are sections similar to FIG. 3 and illustrate various stages of the function of the lock.

In the position shown in FIG. 3, which .is the initial position of the lock, the control pin 14 blocks the locking member 2 with respect to the housing 1, so that no displacement between these parts is possible. When the lock is to be used, e.g. when a combination is to be set for use with a specific key, the key 4 is introduced into the lock as shown in FIG. 6. Suitable means known per se may be present to create sufficient friction between the locking member 2 and the recoding slide 3 so that no relative displacement takes place during the introduction of the key card.

It may be seen that when the key card 4 has been pushed in place in the slot 19 in the recoding slide 3, the coding disks 18*b* and 18*d* have been pushed down into the corresponding coding chambers 15*b* and 15*d* because the key card does not have holes in these positions. On the other hand, no displacement of the coding disks 18*c* and 18*e* has taken place because the key card has holes 20*c* and 20*e* for these positions.

Figure 7:
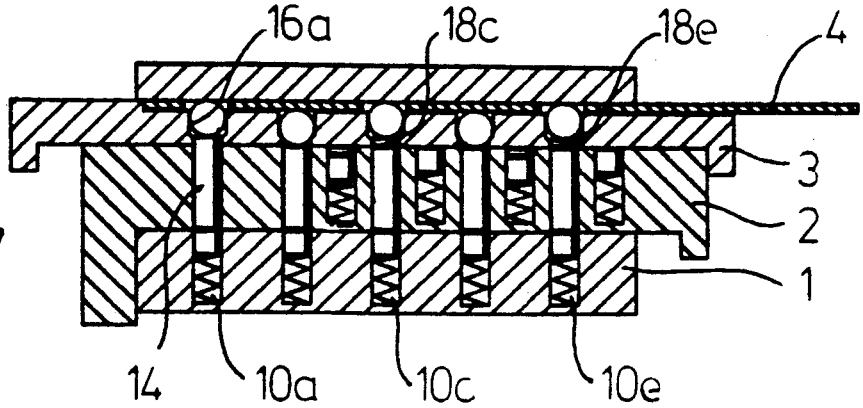

The next step is to subject the key card to a further force in its longitudinal direction so that the friction between the locking element 2 and the recoding slide 3 is overcome. Hereby the recoding slide 3 is displaced towards the left to the position shown in FIG. 7 and brings the coding disks 18*c* and 18*e* along over into the corresponding blocking pin chambers 10*c* and 10*e*. In this position the chamber 16*a* in the recoding slide has also been aligned with the chamber 10*a* for the control pin 14, which, due to the hole 20*a* in the key card 4, has been pushed upwards so that it now locks the recoding slide 3 to the locking element 2, while the locking element 2, on the other hand, is released from the housing 1.

Figure 8:
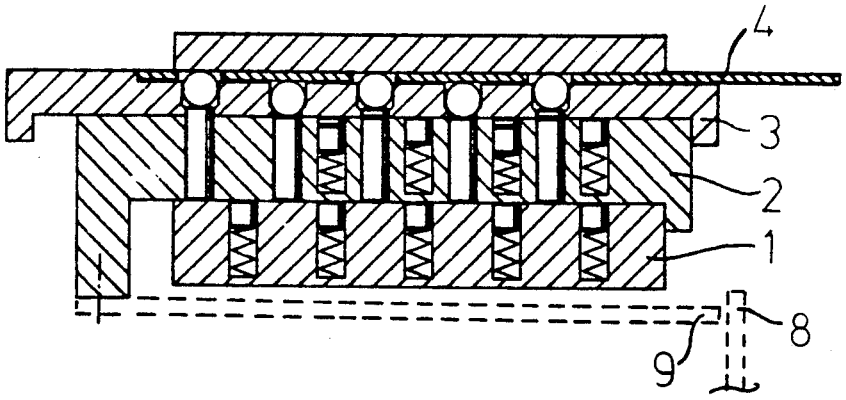

A further force against the key card 4 results in that the locking element 2 and the recoding slide 3 are moved as a unit towards the left to the position shown in FIG. 8. This is the open position of the lock and entails, in the relation shown in FIG. 2, that the blocking projection 9 is pulled back so that the nose 8 may pass, as indicated in broken lines in FIG. 8.

Figure 9:
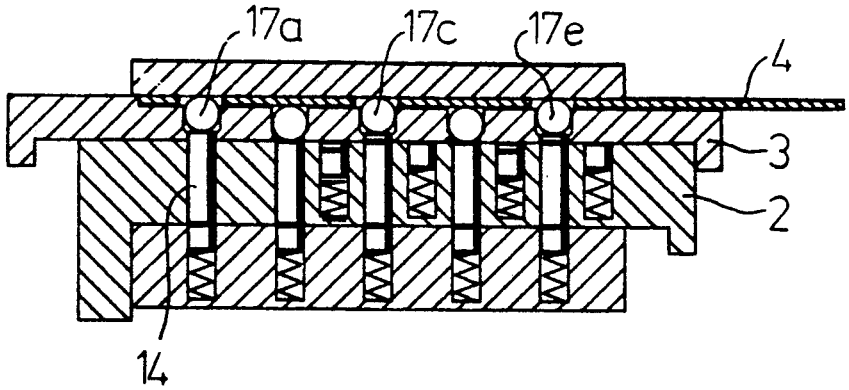

When the lock next is to be locked, the key card 4 is pulled towards the right. Since the key card is held firmly in its slot by means of the spheres 17*a*, 17*c* and 17*e*, the unit consisting of the locking element 2 and the recoding slide 3 is pulled along until the position shown in FIG. 9 is obtained. Since said spheres and the corresponding control and main pins 14 and 13, respectively, now are aligned with their respective blocking pin chambers, the spheres may yield downwards in order for the key card to be pulled entirely out of the lock.

Figure 10:
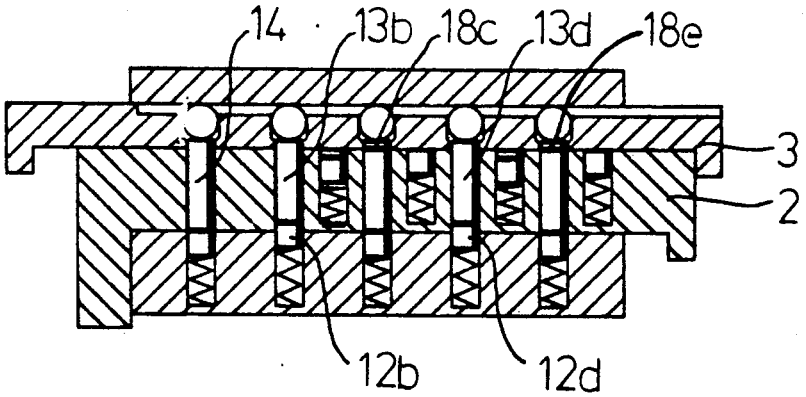

Thus, the situation shown in FIG. 10 has been obtained. Here, the locking element 2 is locked with respect to the housing 1 by means of the casing pins 12*b* and 12*d*. The corresponding main pins and the control pin 14 lock the recoding slide 3 with respect to the locking element. It will be seen that the coding disks 18*c* and 18*e* still remain in the corresponding blocking pin chambers. Therefore, the lock may now be opened only by means of the same key as used the first time.

Figure 11:
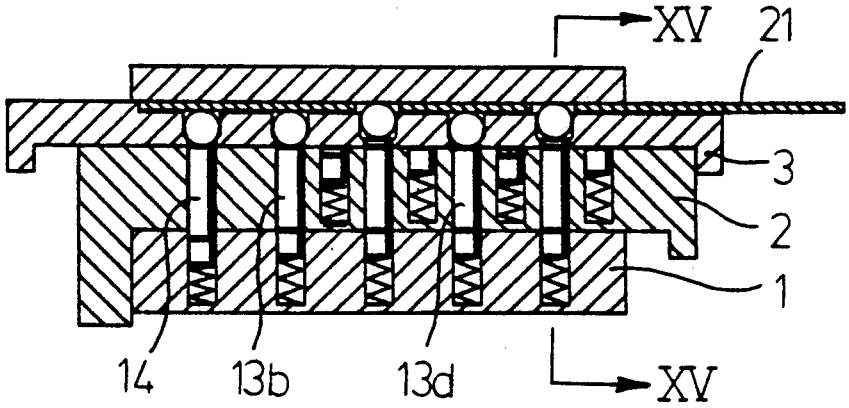

If it is desirable to provide the lock with a new combination, the previous combination must first be erased. This is done by means of an erasing card 21 as shown in FIG. 5. This card has the same combination as the previous key, except that it lacks a hole in position a. When such an erasing card 21 is introduced into the lock, the situation shown in FIG. 11 occurs. Here, the main pins 13*b* and 13*d*, and the control pin 14, are pushed downwards so that they no longer prevent relative movement between the recoding slide 3 and the locking member 2. Concurrently, the control pin 14 locks the locking member to the housing 1, so that the lock may not be opened.

Figure 12:
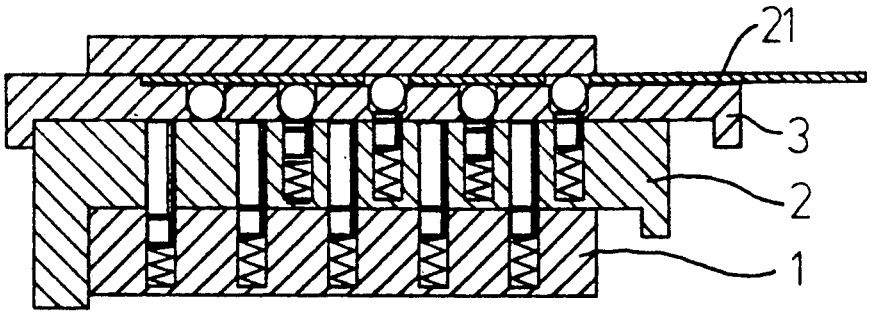

If one at this stage tries to pull the erasing card 21 out of the lock, the recoding slide 3 is first pulled along to the position shown in FIG. 12. This movement of the recoding slide 3 may be promoted by the aid of suitable means, e.g. a spring force acting in the direction of motion between the recoding slide 3 and the housing 1 or the locking member 2.

Figure 13:
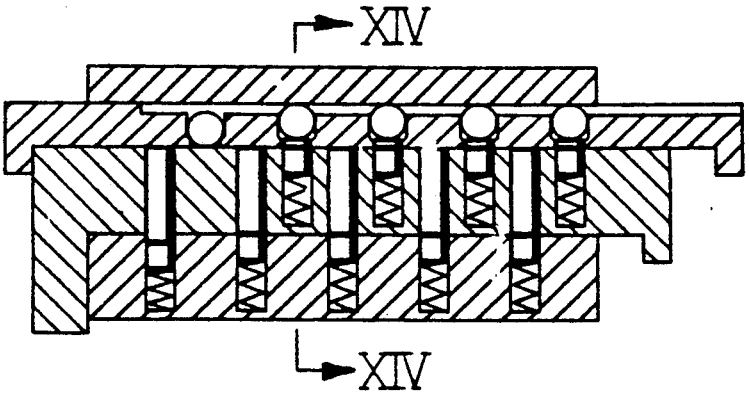
Figure 14:
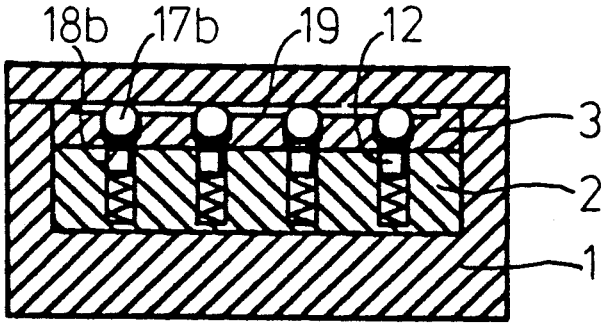
FIG. 14 shows a section along the line XIV—XIV in FIG. 13.

Further pulling of the erasing card 21 will result in the card being pulled out of the slot 19, and the lock will then be left in the condition shown in FIG. 13, i.e. in the same uncoded initial condition as FIG. 3 shows. Thus, the lock is ready for renewed coding by means of any suitable key card.

It will be understood that the invention is not restricted to the exemplifying embodiment described above but that it may be varied and modified in a number of ways within the scope of the appended claims. Thus, one might e.g. envision an embodiment where the unlocking movement of the locking member occurs transversally of the movement of the recoding slide. Embodiments may also be envisioned without said control pin, the movement between the recoding slide and the locking member being controlled in other ways, e.g. manually, during coding and code erasing. Without such a control pin it will not be necessary to use a particular erasing card since the key may be used for this purpose.

I claim:

1. A lock arrangement having a housing (1), a locking member (2) which is movably arranged in the housing (1), a slot (11) for the introduction of a card-shaped key member (4), blocking pins, each having several parts and, by means of the card-shaped key member (4), being mechanically displaceable transversally of the plane of the key member in cylindrical chambers (10) between positions wherein they prevent and permit, respectively, relative movement between the locking member (2) and the housing (1), wherein said locking member (2) comprises coding chambers (15) having springs (11) and the coding disks (18), said coding chambers being arranged in a pattern corresponding to that of the chambers (10) of the blocking pins but being displaced with respect to these, and wherein the lock further comprises a recoding slide (3) which is slidably arranged in the housing (1) and is provided with chambers (16) in a pattern corresponding to that of the chambers (10) of the blocking pins, said slide (3) being positioned adjacent to the locking member (2) and being displaceable with respect to said member between a first and a second position, the chambers (16) of the slide (3) coinciding with the coding chambers (15) of the coding disks (18) in the first position and with the chambers (10) of the blocking pins in the second position.

2. An arrangement according to claim 1, wherein the slot (19) for the key member (4) is arranged in the recoding slide (3).

3. An arrangement according to claim 1 wherein the locking member (2) and the recoding slide (3) are displaceable in the same direction with respect to the housing (1).

4. An arrangement according to claim 1 wherein the relative movement between the recoding slide (3) and the locking member (2) is spring biased.

5. An arrangement according to claim 1 having at least one further chamber (10*a*) for a control pin (14) which has not been assigned a coding chamber (15), wherein the control pin (14) is somewhat longer than the main pins (13) of the blocking pins.

6. A card-shaped key member having a combination in the form of holes (20) for use in a lock according to claim 5, wherein the key member (4) has a hole (20*a*) in the position of the control pin (14).

7. An arrangement for erasing a combination set by means of the key member (4) according to claim 6, wherein the erasing arrangement (21) is formed generally like the key member (4) and has the same hole combination, except that the erasing arrangement does not have a hole in the position for the control pin (14).

* * * * *